United States Patent [19]

Wiese

[11] Patent Number: 5,048,972

[45] Date of Patent: Sep. 17, 1991

[54] TUMBLER LOADER ASSEMBLY

[75] Inventor: Delmar R. Wiese, Springfield, Mo.

[73] Assignee: Custom Metalcraft Inc., Springfield, Mo.

[21] Appl. No.: 457,526

[22] Filed: Dec. 27, 1989

[51] Int. Cl.[5] ..... B01F 11/00

[52] U.S. Cl. ..... 366/213; 414/750

[58] Field of Search ..... 366/200, 204, 208, 209, 366/213, 214; 198/468.6, 465.4, 465.2; 414/495, 750

[56] References Cited

U.S. PATENT DOCUMENTS

| | | | |
|---|---|---|---|
| 2,514,680 | 7/1950 | Stafford | 366/213 |
| 3,746,316 | 7/1973 | Langen | 366/213 |
| 4,775,242 | 10/1988 | Bohle | 366/209 |

*Primary Examiner*—Robert W. Jenkins

*Attorney, Agent, or Firm*—Nies, Kurz, Bergert & Tamburro

[57] ABSTRACT

Apparatus for loading and unloading a container from a tumbler is disclosed. In one embodiment, the tumbler loader assembly of the present invention employs a conveyor along with a loader cart and a tumbler device. The loader cart has the capability of raising and lowering the container as well as moving the container laterally into the tumbler. A track is provided on which the loader cart is mounted for lateral movement between a first position where a container is loaded onto a conveyor from a transfer cart and a second position interior of the tumbler. Upon withdrawal of the loader cart, the container is clamped within the tumbler and the tumbling cycle is carried out. The procedure may then be reversed to remove the container from the tumbler and transfer the container back to the conveyor.

4 Claims, 4 Drawing Sheets

TUMBLER LOADER ASSEMBLY

BACKGROUND AND SUMMARY OF THE INVENTION

The present invention relates to apparatus for loading and unloading a container from a tumbler by mechanical means. More particularly, the present invention relates to an apparatus for vertical and horizontal movement of a tumbler loading device allowing the tumbling cycle to be carried out in a smooth operation along with loading and unloading of the tumbler.

Previous apparatus for use in loading and unloading of mechanical equipment are described in the following U.S. Pat. Nos.: 2,840,219 to Mervyn et al.; 3,746,148 to Hilger et al.; 3,863,890 to Ruffing; and 4,089,100 to Berry.

By the present invention, there is provided a tumbler loader assembly which allows the loading and unloading of a container or bin from a tumbler by the use of mechanical equipment including a transfer cart, a conveyor, a loader cart and a tumbler device.

The present invention provides for a bin to be received from a transfer cart onto a conveyor positioned over a loader cart. The loader cart raises the bin and moves it into the tumbler. The bin is then lowered into position. The loader cart retreats out of the way, and the tumbler clamps the bin and begins the tumbling cycle. When the tumbling cycle is complete, the tumbler stops with the bin in the upright position. The bin is then unclamped and the loader cart advances back under the bin, raising it up and returning it back over the conveyor and the bin is then lowered for automatic loading back onto the transfer cart.

DESCRIPTION OF THE PREFERRED EMBODIMENTS

Figure 1:
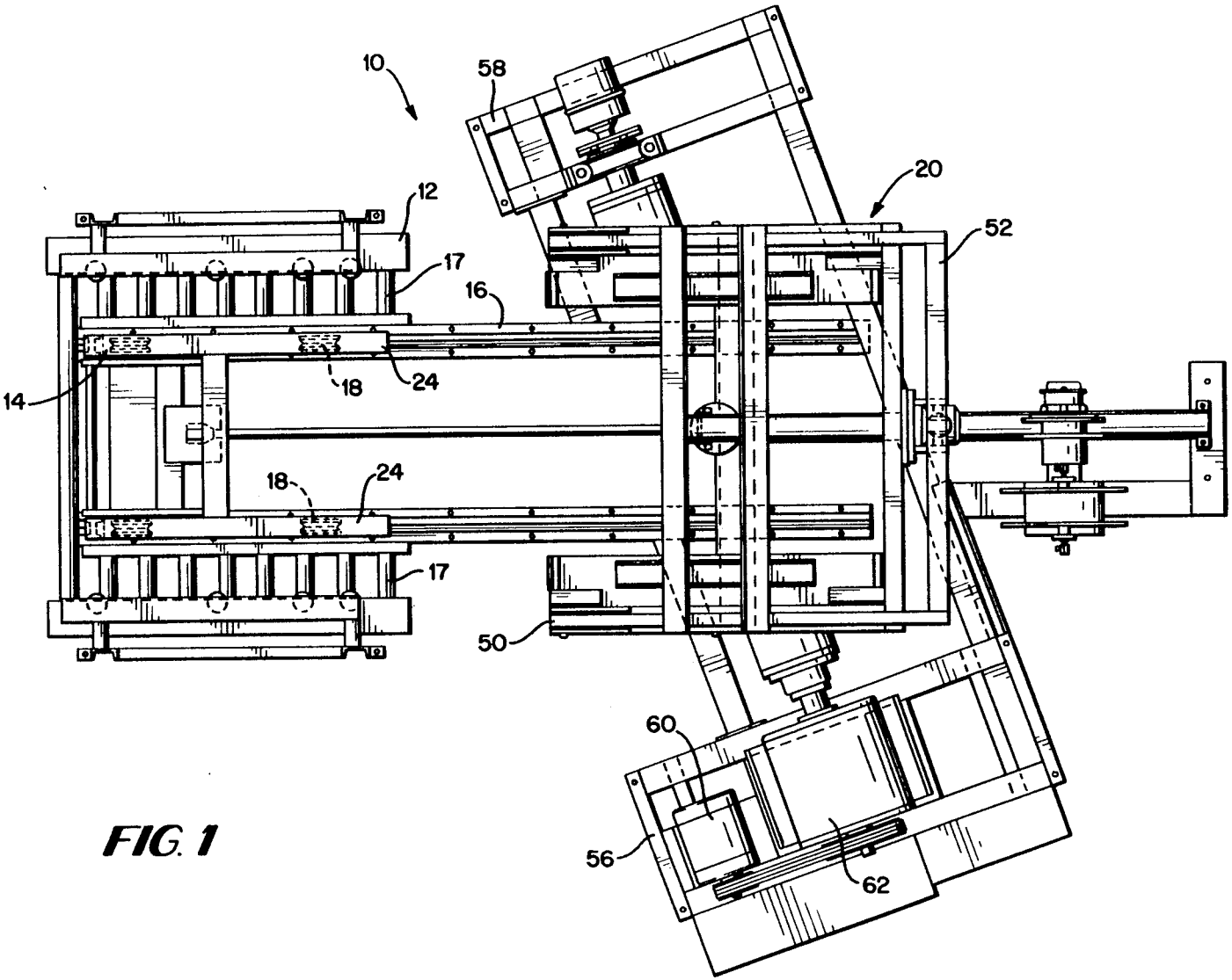
FIG. 1 is a plan view of the tumbler loader assembly of the present invention.
Figure 2:
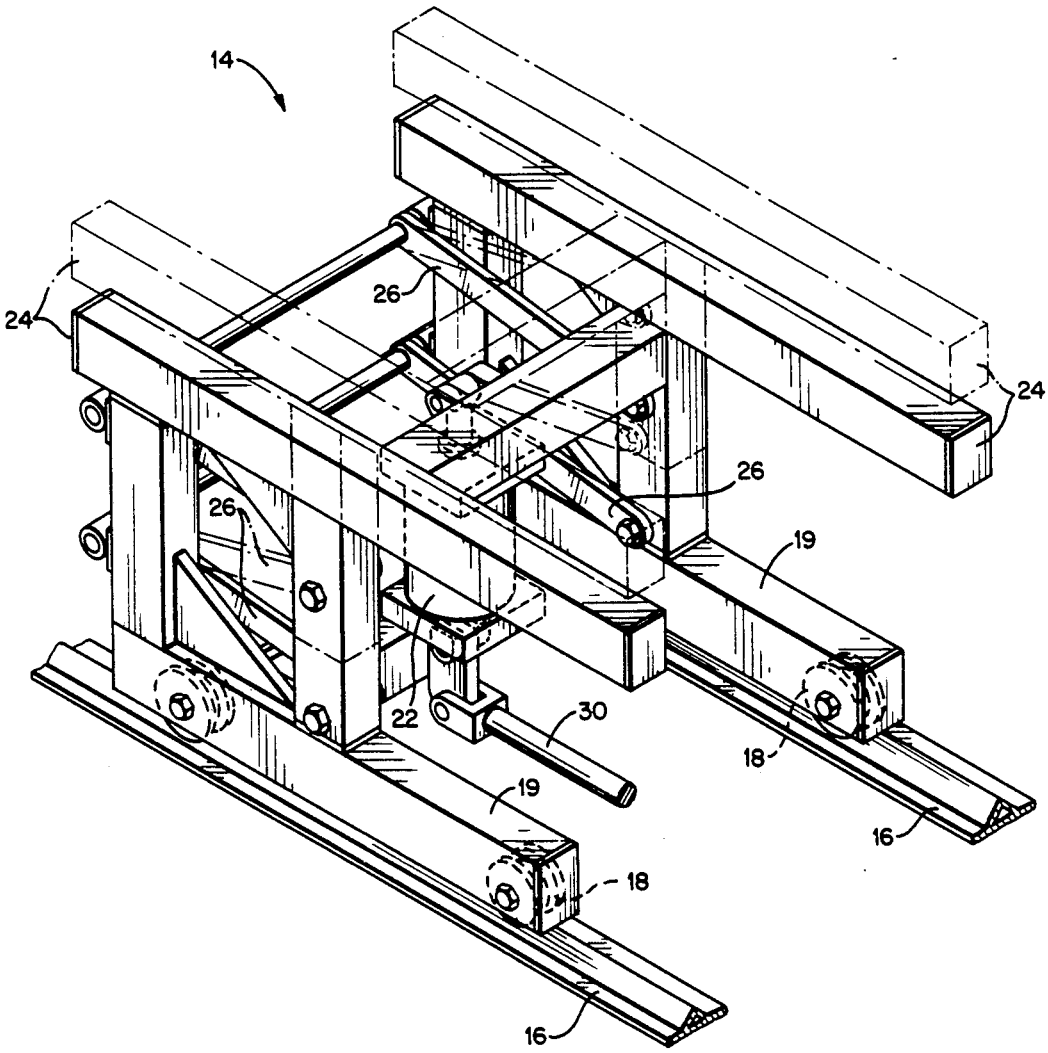
FIG. 2 is a perspective view of the loader cart employed with the tumbler loader assembly of FIG. 1.

In the embodiment of the present invention as shown in FIGS. 1 through 5, there is provided a tumbler loader assembly 10 which includes a conveyor 12 positioned over a loader cart 14. The loader cart 14 is mounted on a track 16 with wheels 18 in lower frame members 19 for movement from (a) a position for loading of a bin from a transfer cart adjacent the conveyor 12 to (b) a position within the tumbler 20.

The loader cart 14 is provided with a pneumatic system 15 in one embodiment which includes a vertical cylinder 22 which raises and lowers the upper frame members 24 by means of a link assembly 26, thus allowing the upper frame 24 to pick up a bin from the conveyor 12. A horizontal cylinder 28 mounted on piston rod 30 is capable of retracting piston rod 30 so as to move the loader cart 14 toward the tumbler 20. The upper frame 24 lowers the bin into the tumbler 20. The horizontal cylinder 28 extends and moves the loader cart 14 back to the original position away from the tumbler 20. The tumbler 20 then tumbles the bin. After tumbling, the loading procedure is reversed.

By the present invention, the bin on the loader cart 14 can be raised from the conveyor 12 and moved laterally into the tumbler 20 with the bin being lowered into the tumbler 20. The cart 14 then moves out of the way so that the cradle of the tumbler 20 can rotate.

Figure 3:
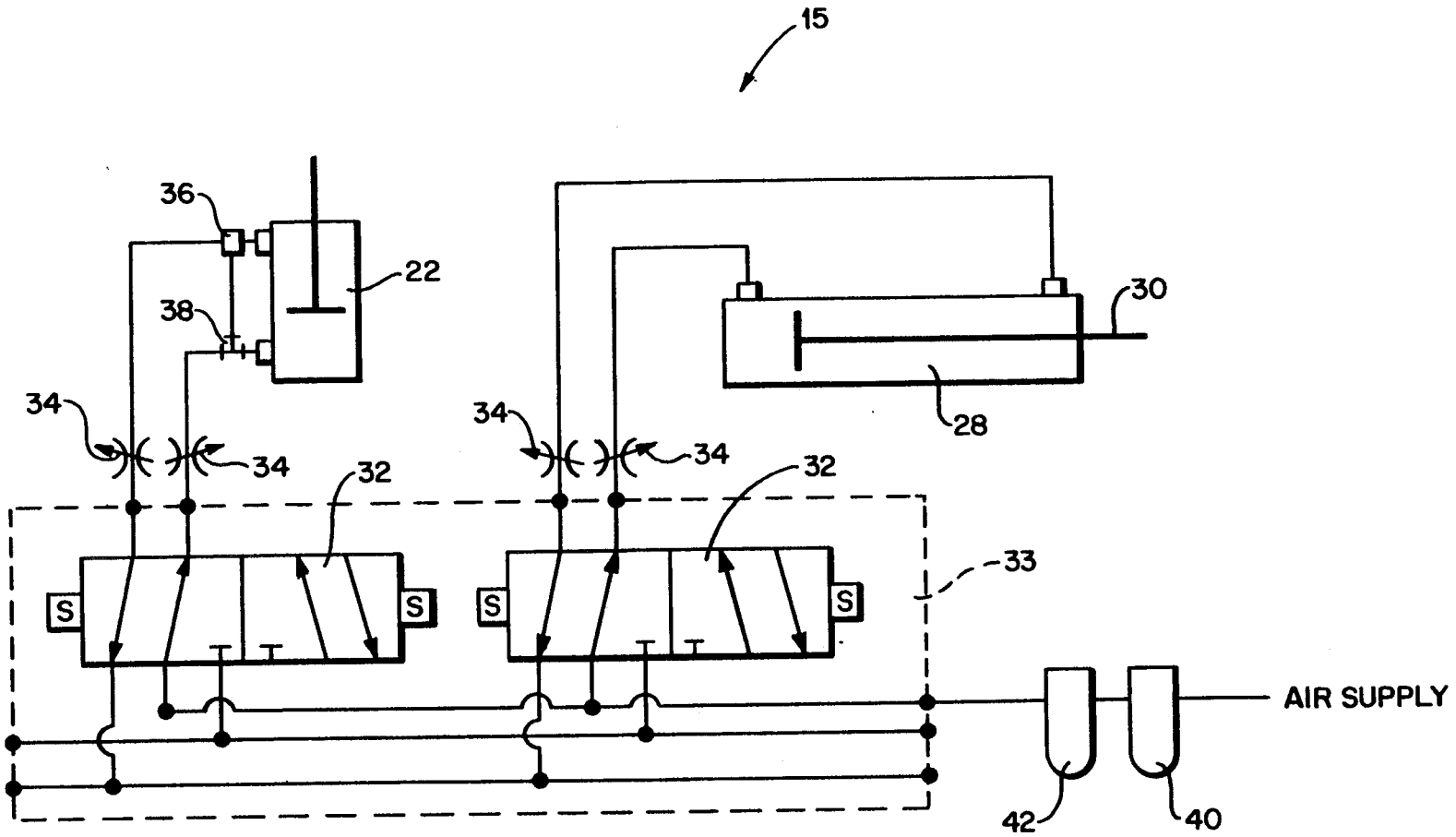
FIG. 3 is a schematic drawing of the pneumatic system employed with the tumbler loader assembly of FIG. 1.

The pneumatic system 15 of the loader cart 14 includes a pair of valves 32 mounted in a manifold kit 33, as shown in FIG. 3. In one embodiment the valves 32 were Norgren valves, No. K 79 EA 50. Between the valves 32 and cylinders 22 and 28, there are provided flow control valves 34, a check valve 36 and tee 38. The system 15 is also provided with a filter 40 and lubricator 42.

In the operation of the system, a bin to be tumbled is transferred in the normal vertical position from a transfer cart onto the conveyor 12 which may be at a height such as about 24 inches above the floor. The legs of the bin will rest on the rollers 17 of the conveyor 12. Upon operation of the pneumatic system of the loader cart 14, the upper frame members 24 are raised so as to lift the bin and support the bottom of the bin between the legs thereof. The loader cart 14 is then moved toward the tumbler 20. As the loader cart 14 approaches the tumbler 20, the tumbler 20 is in the open position as shown in FIG. 4.

Figure 4:
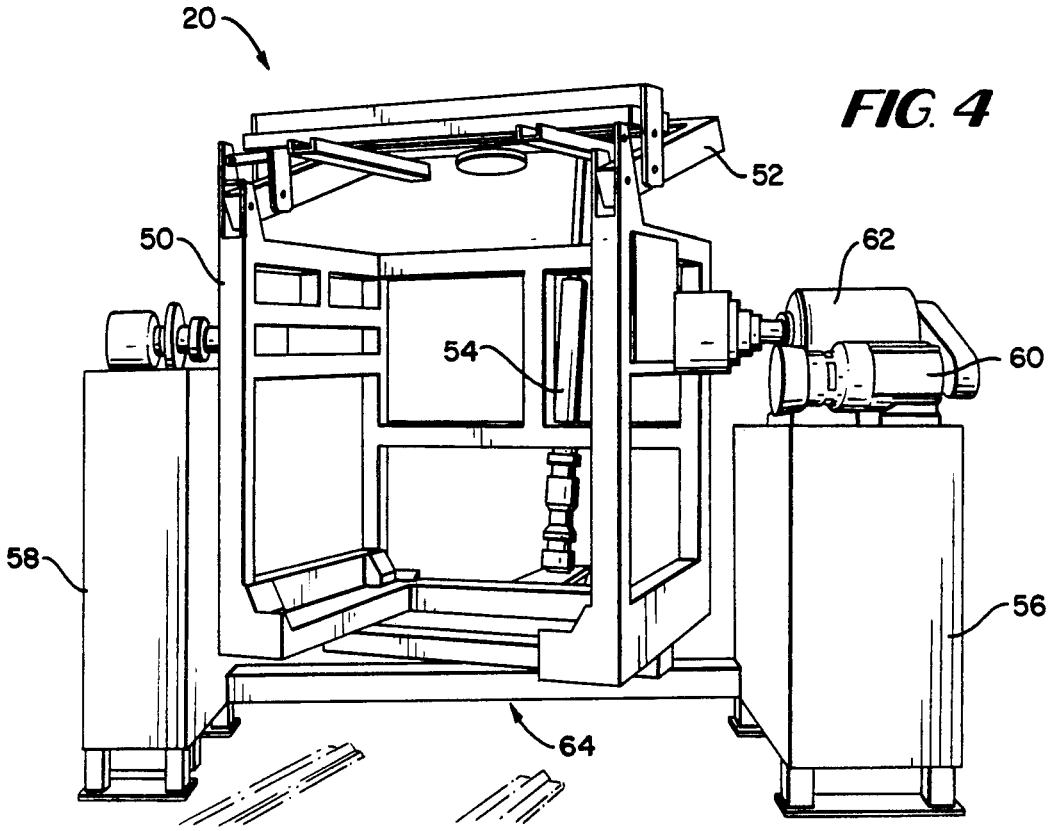
FIG. 4 is a perspective view of a tumbler employed in the tumbler loader assembly of the present invention.
Figure 5:
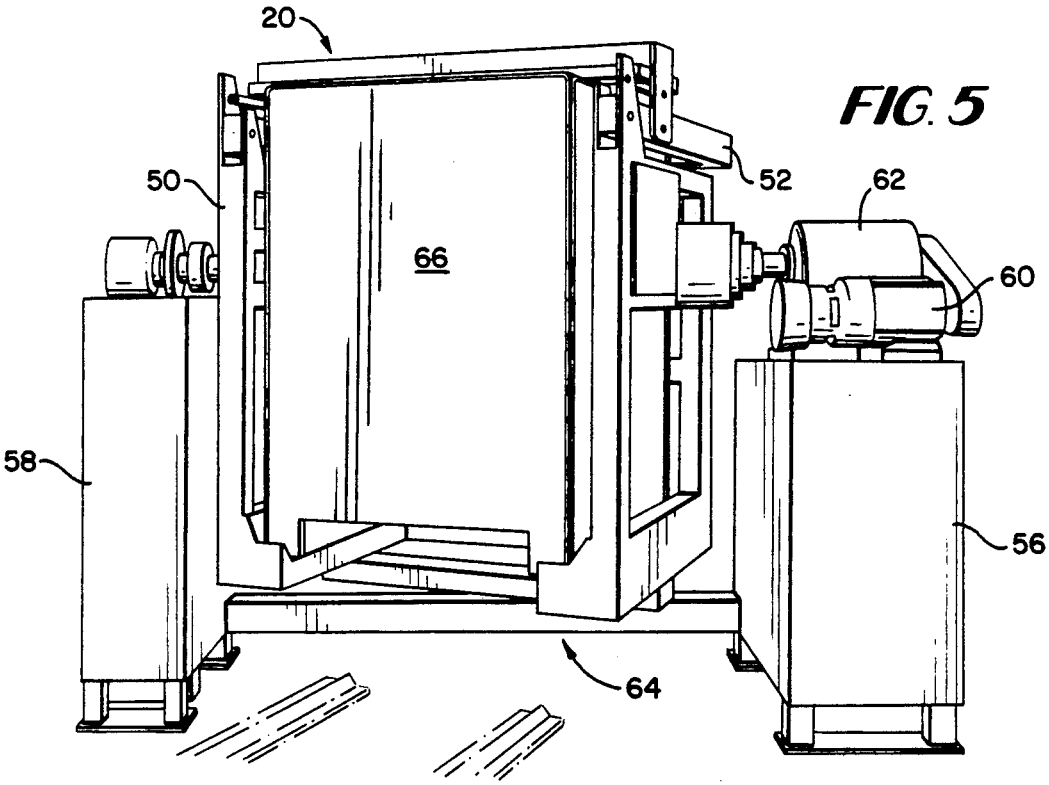
FIG. 5 is a perspective view of the tumbler of FIG. 4 showing a bin positioned in the tumbler.

The tumbler 20 may be any conventional tumbler apparatus such as that shown in FIGS. 4 and 5, having a cradle 50 with upper clamp frame assembly 52 and a screw actuator 54 for clamping the bin securely in the cradle 50. Equipment for operating the tumbler 20 includes the support frame assembly 56, 58, the drive motor 60 and gear reducer 62.

The cradle 50 is provided with an open lower end 64 to allow the loader cart 14 to move inwardly and lower the bin into position within the tumbler cradle 50. In FIG. 5, there is shown a bin 66 in position within the cradle 50 with the clamp frame assembly 52 in the clamped position so that the bin is ready for the tumbling operation.

A tumbler unit may be employed having an automatic cycle such as the following:

(a) clamping the bin in place and verifying the position;

(b) accelerating and tumbling the bin for a pre-set number of revolutions;

(c) decelerating and stopping the bin in an upright position; and (d) unclamping the bin, thus completing the cycle.

In one embodiment, the assembly 10 of the present invention was employed to load and tumble a container having base dimensions of 48 inches by 48 inches, with an overall height of 73½ inches and a maximum product load of 3,500 lbs. The tumbling speed was approximately 5 to 15 rpm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A tumbler loader assembly for tumbling a bin or other container, comprising:

a loader cart having means for raising and lowering said bin;

a horizontally disposed conveyor positioned above and outwardly of the loader cart for transferring the bin to said loader cart;

means for tumbling said bin; and means for lateral movement of said loader cart between a first loading position exterior to said tumbling means and a second loading position interior of said tumbling means.

2. The tumbler loader assembly of claim 1 wherein said loader cart is provided with means for moving the bin laterally into the tumbling means and lowering the bin into position for tumbling within a cradle in said tumbling means.

3. The tumbler loader assembly of claim 2 wherein said tumbling means includes a cradle having an open lower end to allow said loader cart with the bin to be received interiorly of said cradle.

4. The tumbler loader assembly of claim 3 including a track located between said first and second loading positions and further including means for mounting said loader cart for movement along said track.

* * * * *